US011506153B2

(12) United States Patent
Styles et al.

(10) Patent No.: US 11,506,153 B2
(45) Date of Patent: Nov. 22, 2022

(54) EGR PRE-MIXER FOR IMPROVED MIXING

(71) Applicant: Ford Global Technologies, LLC, Dearborn, MI (US)

(72) Inventors: Daniel Joseph Styles, Canton, MI (US); Eric Matthew Kurtz, Dearborn, MI (US); Liangjun Hu, Bloomfield Hills, MI (US); Daniel William Kantrow, Ann Arbor, MI (US); Darrell Sparks, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/212,947

(22) Filed: Mar. 25, 2021

(65) Prior Publication Data

US 2022/0307451 A1 Sep. 29, 2022

(51) Int. Cl.

| | |
|---|---|
| ***F02M 26/13*** | (2016.01) |
| ***F02M 35/10*** | (2006.01) |
| ***B01F 23/10*** | (2022.01) |
| ***B01F 25/313*** | (2022.01) |

(52) U.S. Cl.

CPC ..... *F02M 26/13* (2016.02); *B01F 23/10* (2022.01); *B01F 25/313* (2022.01); *F02M 35/10222* (2013.01); *F02M 35/10262* (2013.01)

(58) Field of Classification Search

CPC ..... F02M 26/13; F02M 35/10222; F02M 35/10262; B01F 3/02; B01F 5/045

See application file for complete search history.

(56) References Cited

U.S. PATENT DOCUMENTS

| | | | | |
|---|---|---|---|---|
| 6,298,835 | B1 | 10/2001 | Horie et al. | |
| 7,845,340 | B2 * | 12/2010 | Fuchinoue | F02M 35/10222 123/568.17 |
| 7,926,473 | B2 * | 4/2011 | Currie | F02M 26/34 123/590 |
| 2004/0079347 | A1 * | 4/2004 | Bender | F02M 35/10222 123/568.17 |
| 2014/0165974 | A1 * | 6/2014 | Mahakul | F02M 26/13 123/568.11 |

FOREIGN PATENT DOCUMENTS

| | | | |
|---|---|---|---|
| CN | 104005886 | A | 8/2014 |

* cited by examiner

*Primary Examiner* — Syed O Hasan

(74) *Attorney, Agent, or Firm* — Vincent Mastrogiacomo; Brooks Kushman, P.C.

(57) ABSTRACT

An exhaust gas recirculation system for an engine includes a conduit, and a U-shaped exhaust gas mixer. The conduit is configured to direct an exhaust gas away from an exhaust manifold. The U-shaped exhaust gas mixer is configured to direct exhaust gas from the conduit and into an engine air intake system. The U-shaped exhaust gas mixer is arranged with a pre-mixing cavity configured to disperse the exhaust gas and entraining the exhaust gas into an intake air flow prior to distribution into an intake manifold of an engine.

19 Claims, 5 Drawing Sheets

EGR PRE-MIXER FOR IMPROVED MIXING

TECHNICAL FIELD

The present disclosure relates to exhaust gas recirculation systems for internal combustion engines.

BACKGROUND

Internal combustion engines may include exhaust gas recirculation systems that are configured to redirect exhaust gas into the air intake system of the engine to reduce emissions.

SUMMARY

A vehicle includes an internal combustion, an air intake system, an exhaust system, and an exhaust gas recirculation system. The internal combustion engine has at least one cylinder. The air intake system is configured to deliver air to the at least one cylinder. The exhaust system has at least one conduit configured to direct exhaust gas away from the at least one cylinder. The exhaust gas recirculation system has a at least one tube, and a U-shaped exhaust gas mixer. The at least one tube is configured to direct the exhaust gas away from the at least one conduit. The U-shaped exhaust gas mixer is configured to direct the exhaust gas from the at least one tube, into the air intake system. The U-shaped exhaust gas mixer forms a pre-mixing cavity, the pre-mixing cavity configured to maintain an exhaust gas flow pressure during a dispersing and entraining of the exhaust gas with the intake air as the intake air flows through the U-shaped exhaust mixer prior to delivering the intake air and exhaust gas to the at least one cylinder.

An exhaust gas recirculation system for an engine includes a conduit, and a U-shaped exhaust gas mixer. The conduit is configured to direct exhaust gas away from an exhaust manifold. The U-shaped exhaust gas mixer is configured to direct exhaust gas from the conduit, into an engine air intake system. The U-shaped exhaust gas mixer is arranged with a pre-mixing cavity, the pre-mixing cavity is configured to disperse the exhaust gas and entraining the exhaust gas into an intake air flow prior to distribution into an intake manifold of an engine.

An exhaust gas recirculation mixer for an engine exhaust system includes a housing having an exhaust gas inlet an intake air inlet, and at least one pre-mixing conduit configured between the exhaust gas inlet and the intake air inlet. The pre-mixing conduit configured to distribute and disperse a volume of exhaust gas prior to entraining the exhaust gas in at least a portion of an intake air main flow and prior to distribution into the engine.

DETAILED DESCRIPTION

Figure 1:
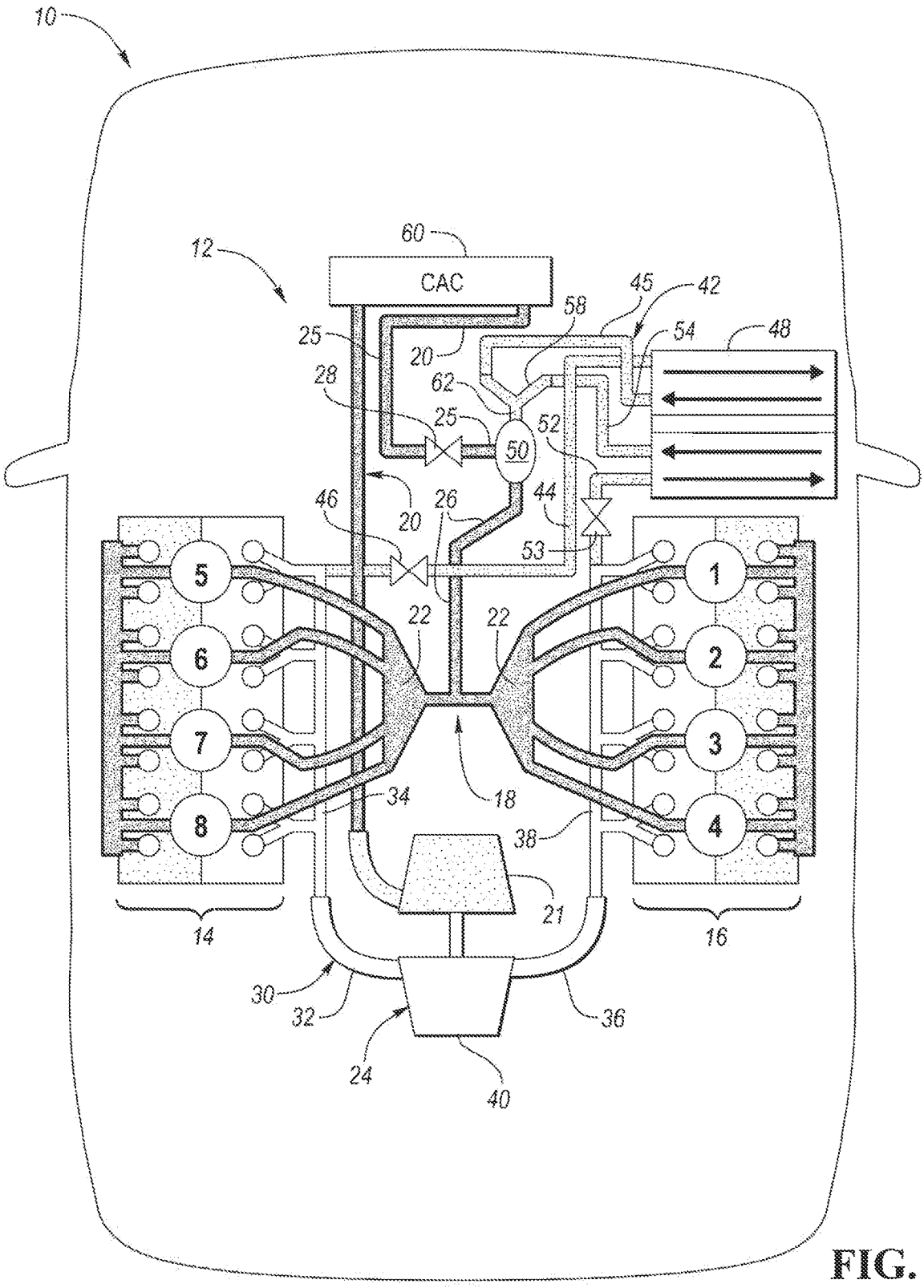
FIG. 1 is a schematic illustration of an exemplary vehicle having an internal combustion engine.

Embodiments of the present disclosure are described herein. It is to be understood, however, that the disclosed embodiments are merely examples and other embodiments may take various and alternative forms. The figures are not necessarily to scale; some features could be exaggerated or minimized to show details of specific components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for specific applications or implementations.

Exhaust gas recirculation (EGR) is used on diesel and gas internal combustion engines and is an important method to reduce NOx emissions via peak combustion temperature reduction and on gas engines to reduce $CO_2$ via reduced pump work and knock mitigation. EGR is taken off from the exhaust system and reintroduced into the intake system, where it needs to be mixed prior to entering the engine cylinders. The flow of EGR is typically unsteady due to the discrete number of engine cylinders and asymmetric takeoff location where one cylinder is contributing more exhaust flow to the EGR system than others.

With the more stringent emission criteria being established, especially with low NOx and $CO_2$ emission requirements, there is a strong need to improve the engine exhaust gas recirculation distribution uniformity. However, due to the unsteady EGR flow current EGR systems require long mixing times, very elaborate EGR mixers and/or a revised EGR takeoff such as a dual bank EGR takeoff, which all add cost, consume package space and in the case of the EGR mixing length the elaborate EGR mixers increase pressure losses and reduce flow capabilities of the exhaust gas and an intake/charge air. Thus, to meet the low NOx and $CO_2$ emission and avoid these system challenges with the elaborate EGR mixers, a low pressure drop EGR pre-mixer is needed to provide an initial cavity for the unsteady EGR gases to mix and diffuse into a volume before being entrained into the main flow for further micro mixing of the EGR with the intake or charge air. This EGR pre-mixer may largely reduce the issue of the EGR being entrained into the main flow of charge air as discrete slugs of EGR, which results in a lean or rich EGR zone in the main intake air flow that must diffuse over time. Thus, the innovative simple EGR pre-mixer, disclosed herein, provides a low-pressure loss mixer that eliminates the very long mixing lengths, the high-pressure losses and unevenly mixed EGR caused by the current elaborate EGR mixers.

In the current disclosure, a low-pressure loss pre-mixer, which introduces the EGR into a volume configured adjacent the main flow of intake air where diffusion of the EGR occurs. More specifically, once the volume of EGR is introduced it is then entrained into the main flow in steady fashion without significant pressure losses, which avoids expensive EGR system elements such as backpressure valves and EGR pumps that are typically required to flow the necessary EGR rates. The main goal is to enable improved exhaust gas mixing while minimizing the pressure losses in the system to promote EGR flow dispersion into a pre-mixing zone or chamber prior to entrainment into the main flow of intake air. The exhaust gas recirculation flow is introduced and dispersed into the premixing zone and then entrained into the main flow where further mixing occurs prior to distribution to the engine cylinders. This new pre-mixer allows for a shorter mixing length while providing a homogenous EGR distribution from cylinder-to-cylinder. Thus, the pre-mixer, as disclosed, enables better EGR mixing while allow for reduced EGR pressure losses, reduced EGR mixing lengths and includes lower cost asymmetric EGR takeoffs thereby eliminating the need for expensive EGR system components, such as, the elimination of EGR backpressure valves and EGR pumps used to maintain the required amount of EGR in the system.

Referring to FIG. 1, a schematic illustration of an exemplary vehicle 10 having an internal combustion engine 12 is illustrated. The engine 12 may be configured to provide power and torque to wheels to propel the vehicle 10. The engine 12 may include any known configuration of cylinders such as, but not limited to a single cylinder bank engine having a single or a plurality of cylinders or a double cylinder bank engine having a plurality of cylinders, each bank of the double bank having an equal number of cylinders. The engine 12 may include any known configuration of two cylinders, three cylinders, four cylinders, six cylinders or other known vehicle engine configurations with any known fuel system that produces an exhaust gas 66 such as, but not limited to diesel, gas, propane and natural gas. As illustrated in the exemplary vehicle 10, the engine 12 includes a first bank of cylinders 14 and a second bank of cylinders 16.

The engine 12 includes an air intake system 18. The air intake system 18 may include a set of pipes, tubes, or conduits 20 that are configured to deliver an air supply to each cylinder to provide the oxygen required for the combustion of fuel. The set of pipes, tubes, or conduits 20 may include one or more first intake pipes tubes or conduits 25 housing a throttle valve 28, one or more second air intake pipes tubes or conduits 26 directly connected to one or more air intake manifolds 22, the intake manifolds 22 directly deliver the intake air 64 into each cylinder. The first intake pipe, tube, or conduit 25 of the set of pipes, tubes, or conduits 20 may draw intake air 64 directly from an ambient environment or may receive air from a compressor 21 of a turbocharger 24 or supercharger. If a turbocharger 24 or supercharger is delivering the intake air 64 into the air intake system 18, the intake air 64 may first be sent to a charge air cooler 60. From the charge air cooler 60, the intake air 64 may then pass by the throttle valve 28, through the second air intake pipes tubes or conduits 26 and the air intake manifolds 22 and into the cylinders which may be in at least one of the first bank of cylinders 14 and of the second bank of cylinders 16. The throttle valve 28 is adjusted by an operator of the vehicle 10 by depressing an accelerator pedal (not shown) in conjunction with an adjustment to the amount of fuel being delivered into the cylinders based on a power or torque demand of the engine 12 or the wheels of the vehicle 10, which is interpreted by a controller (not shown) based on a position of the accelerator pedal.

The controller may be a powertrain control unit (PCU), may be part of a larger control system, and may be controlled by various other controllers throughout the vehicle 10, such as a vehicle system controller (VSC). It should therefore be understood that the controller and one or more other controllers can collectively be referred to as a "controller" that controls various actuators in response to signals from various sensors to control functions such as starting/stopping the engine 12, operating the engine 12 to provide wheel torque, select or schedule shifts of a transmission of the vehicle 10, etc.

The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the engine 12 or vehicle 10.

As illustrated, the engine 12 also includes an exhaust system 30. The exhaust system 30 is configured to direct exhaust gas 66 away from the cylinders of the engine 12. The exhaust system 30 may include a first set of exhaust gas pipes, tubes, or conduits 32 that are configured to direct exhaust gas 66 away from the first bank of cylinders 14. The first set of exhaust pipes, tubes, or conduits 32 may include a first exhaust manifold 34 that directly receives the exhaust gas 66 from the first bank of cylinders 14. The exhaust system 30 may include a second set of exhaust pipes, tubes, or conduits 36 that are configured to direct exhaust gas 66 away from the second bank of cylinders 16. The second set of exhaust pipes, tubes, or conduits 36 may include a second exhaust manifold 38 that directly receives the exhaust from the second bank of cylinders 16. The exhaust gas 66 may be channeled to one or more exhaust tail pipes (not shown), via the first set of exhaust pipes, tubes, or conduits 32 and the second set of exhaust pipes, tubes, or conduits 36, wherein the exhaust gas 66 is dumped into the ambient environment outside the vehicle 10. At least one intermediate component of the exhaust system 30 may be disposed between the exhaust manifolds 34, 38 and the one or more tailpipes (not shown). Such intermediate component may include one or more mufflers, one or more catalytic converters, and a turbine 40 if the vehicle 10 includes the turbocharger 24, etc.

The engine 12 also include an exhaust gas recirculation system 42. The exhaust gas recirculation system 42 may include a first exhaust gas recirculation pipe, tube, or conduit 44 that is configured to direct a first portion of the exhaust gas 66 away from the first set of exhaust pipes, tubes, or conduits 32 of the exhaust system 30. More specifically, the first exhaust gas recirculation pipe, tube, or conduit 44 may be configured to direct the first portion of the exhaust gas 66 away from the first exhaust manifold 34, thereby directing the first portion of exhaust gas 66 away from the first bank of cylinders 14. The first exhaust gas recirculation pipe, tube, or conduit 44 may be comprised of one or more pipes, tubes, or conduits. A first exhaust gas recirculation valve 46 may be disposed along the first exhaust gas recirculation pipe, tube, or conduit 44 to control the amount of exhaust flowing through the first exhaust gas recirculation pipe, tube, or conduit 44. The first exhaust gas recirculation pipe, tube, or conduit 44 directs the first portion of the exhaust gas 66 into an exhaust gas recirculation cooler 48. The first portion of the exhaust gas 66 is then directed toward a mixer 50 via a second pipe, tube, or conduit 45.

The exhaust gas recirculation system 42 may include a third exhaust gas recirculation pipe, tube, or conduit 52 that is configured to direct a second portion of the exhaust gas 66 away from the second set of pipes, tubes, or conduits 36 of the exhaust system 30. More specifically, the third exhaust gas recirculation pipe, tube, or conduit 52 may be configured to direct the second portion of the exhaust gas 66 away from the second exhaust manifold 38, thereby directing the second portion of exhaust gas away 66 from the second bank of cylinders 16. The third exhaust gas recirculation pipe, tube, or conduit 52 may be comprised of one or more pipes, tubes, or conduits. A second exhaust gas recirculation valve 53 may be disposed along the third exhaust gas recirculation pipe, tube, or conduit 52 to control the amount of exhaust gas 66 flowing through the third exhaust gas recirculation pipe, tube, or conduit 52. The third exhaust gas recirculation pipe, tube, or conduit 52 directs the second portion of the exhaust gas 66 into the exhaust gas recirculation cooler 48. The first and second portions of the exhaust gas 66 may be combined into a single flow path or fluid path in the exhaust gas recirculation cooler 48 or the first and second portions of exhaust gas may be segregated from each other when passing through the exhaust gas recirculation cooler 48. The second portion of the exhaust gas 66 is then directed toward the mixer 50 via a fourth pipe, tube, or conduit 54. The fourth pipe, tube, or conduit 54 may be comprised of one or more pipes, tubes, or conduits.

It should be understood that the second pipe, tube, or conduit 45 and the fourth pipe, tube, or conduit 54 may be directly connected to the mixer 50 or alternatively the second and fourth conduits may be connected to the mixer 50 through a Y-pipe, Y-tube or Y-conduit 58 as the mixer 50 may include a single inlet 62. Generally, the mixer 50 flows the intake air 64 past and entraining the exhaust gas 66, into the pipes, tubes, or conduits 26 of the air intake system 18 for introduction into the air intake manifold 22. This mixture of entraining the exhaust gas 66 with the intake air 64 results in a homogenous charge air 68 for use in at least one of the first bank of cylinders 14 and second bank of cylinders 16 within a tight device package footprint over a short distance without the use of a backpressure valve or an EGR pump.

Figure 2:
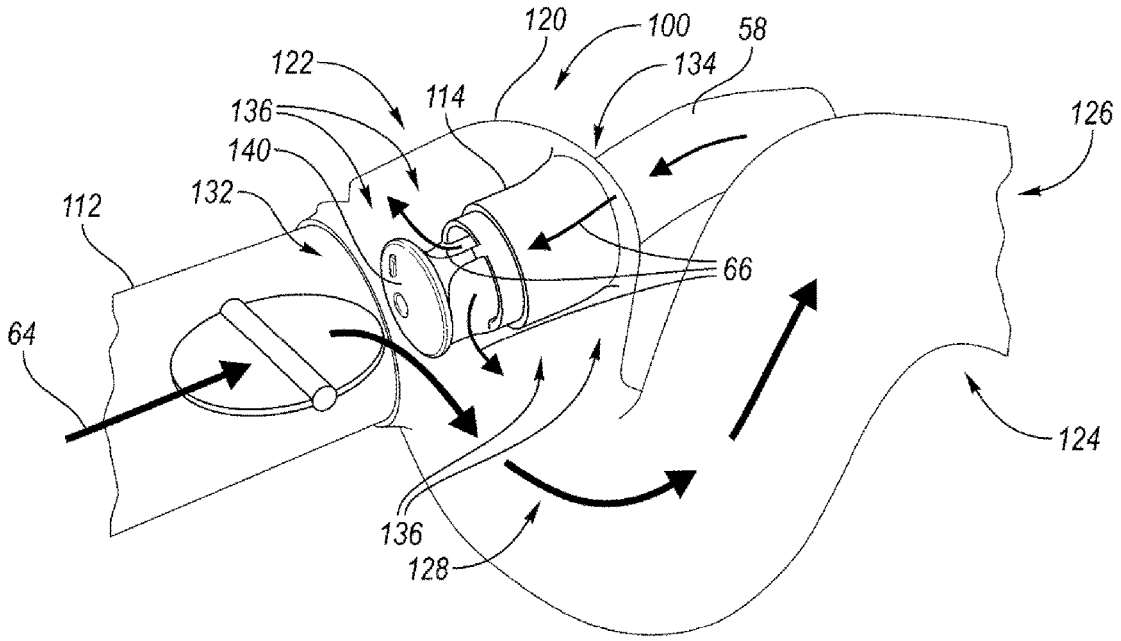
FIG. 2 is a schematic view of an exemplary exhaust gas recirculation mixer system having an air intake tube connected to a U-shaped exhaust gas mixing cavity for an exhaust gas recirculation system.
Figure 3:
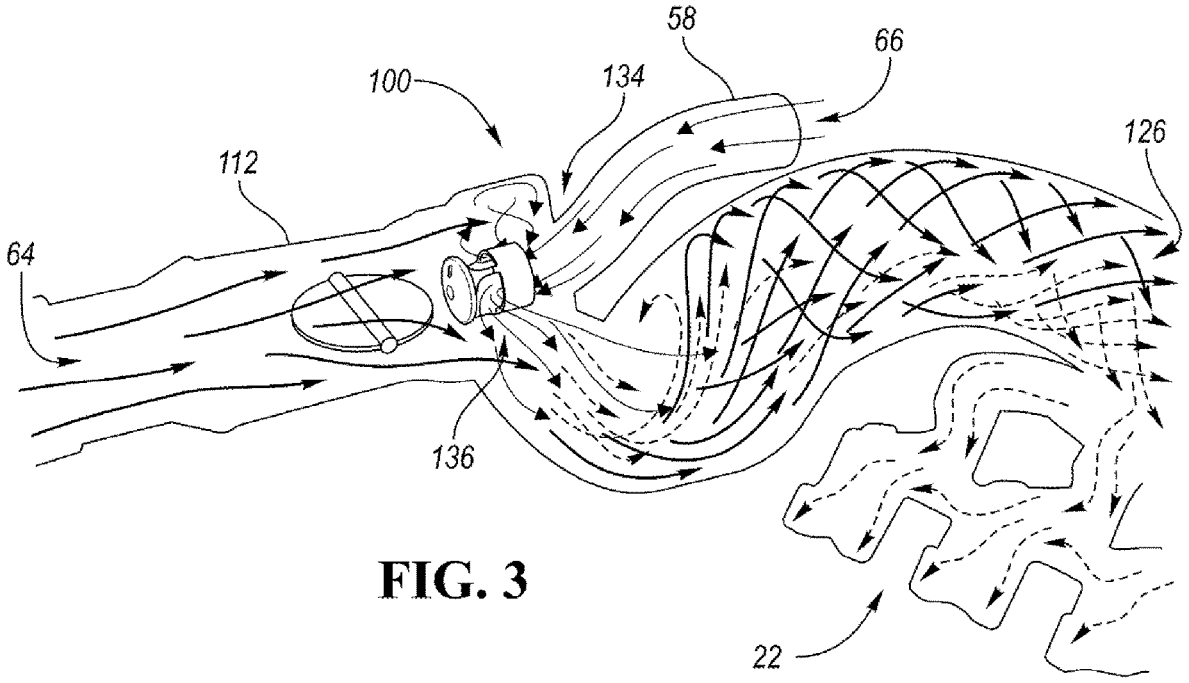
FIG. 3 is a schematic view of an exemplary computational fluid dynamics flow of an intake air and an entrained exhaust gas in the exhaust gas recirculation system of FIG. 2.

FIGS. 2 and 3 illustrate a mixer 100 for an exhaust gas recirculation system 42. The mixer 100 may correspond to mixer 50 in FIG. 1. The mixer 100 is configured to direct and mix the exhaust gas 66 entering from the second pipe, tube, or conduit 45, the fourth pipe, tube, or conduit 54, or the Y-pipe, Y-tube, or Y-conduit 58, with the intake air 64 coming from the ambient environment or the charge air cooler 60. The mixer 100 may include a U-shaped housing 120, the housing 120 defining a first end 122 and a second end 124 with a mixing chamber 128 configured therebetween. The first end 122 may include an intake air inlet 132 connected to an intake tube 112, which may correspond with the first intake pipes, tubes or conduits 25, an exhaust gas inlet 134, which may correspond with the single inlet 62, and a pre-mixing cavity 136. The second end 124 may include the mixing chamber 128 and a mixer outlet also known as a charge air outlet 126, the second end 124 is fluidly connecting the homogenous charge air 68 with the intake manifold 22.

As discussed previously and illustrated herein, at least in FIGS. 2 and 3, the intake air 64 enters the U-shaped housing 120 from the intake tube 112 while the exhaust gas 66 enters the U-shaped housing 120 through the exhaust gas inlet 134 passing through a pre-mixing conduit 114 and out a pre-mixing head 140 and into the pre-mixing cavity 136. Once in the pre-mixing cavity 136, the intake air 64 flows around the pre-mixing conduit 114 and the pre-mixing head 140 thereby entraining the exhaust gas 66 into the intake air 64 mixing and forming the homogenous charge air 68. The homogenous charge air 68 may continue to swirl and mix as it flows through the mixing chamber 128, out of the charge air outlet 126 and into the intake manifold 22. It should be understood that the pre-mixing cavity 136, the pre-mixing conduit 114 and the pre-mixing head 140 combined make up a pre-mixing zone, the pre-mixing zone is configured to promote an exhaust gas recirculation flow dispersion prior to entrainment of the exhaust gas 66 entrainment into the main flow of intake air 64. The computational fluid dynamics model illustrated as FIG. 3 illustrates the intake air 64 entering through the intake tube 112, the exhaust gas 66 entering the mixer 100 at a rear wall, the exhaust gas 66 becoming entrained with the intake air 64 and creating a homogenous mix of entrained exhaust gas 66 with intake air 64 resulting in the homogenous charge air 68 flowing into the intake manifold 22.

Figure 4:
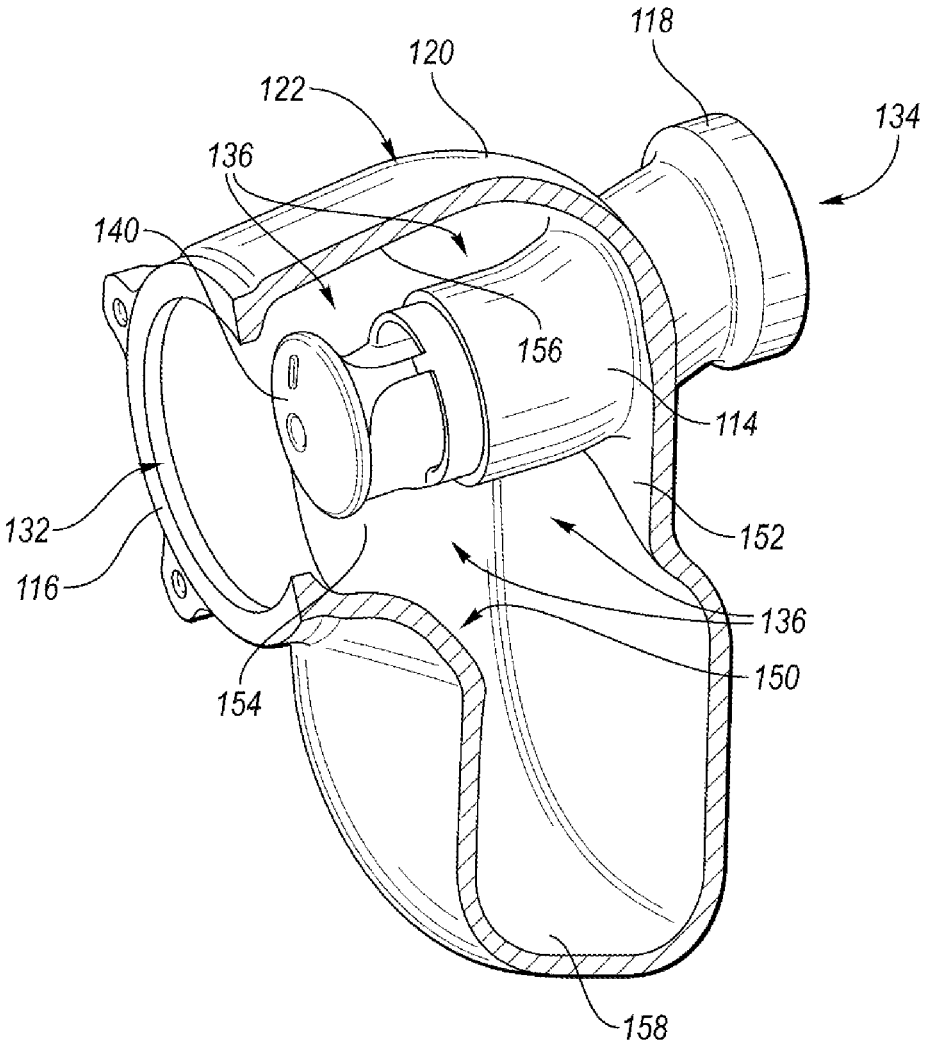
FIG. 4 is a partial section view of a first half of the U-shaped exhaust gas mixer of FIG. 2.

Turning to FIGS. 4-7, various sections and cutaway illustrations are included to demonstrate the internal structure of the mixer 100. Specifically, FIG. 4 illustrates the internal detail of the first end 122 of the U-shaped housing 120. As illustrated, the first end 122 includes an annular air intake mounting flange 116 extending radially around the intake air inlet 132 and configured to connect the U-shaped housing 120 to the intake tube 112. The intake air inlet 132 may be configured as an annular opening or aperture providing a circular intake at the annular air intake mounting flange 116. An exhaust gas inlet mounting flange 118 may also be included, the exhaust gas inlet mounting flange 118 extending radially around the exhaust gas inlet 134 and configured to connect the U-shaped housing 120 to at least one of the Y-pipe, Y-tube or Y-conduit 58, the single inlet 62, second pipe, tube, or conduit 45 and the fourth pipe, tube, or conduit 54. The pre-mixing cavity 136 surrounds the pre-mixing conduit 114 and the pre-mixing head 140, the pre-mixing cavity 136 is confined by a front-inner housing wall 150, a rear-inner housing wall 152, a left-side housing wall 154, and a first-top housing wall 156. The front-inner housing wall 150 also defines the intake air inlet 132 while the rear-inner housing wall 152 supports the pre-mixing conduit 114 extending there from. The pre-mixing cavity 136 is a hollow area within the U-shaped housing 120 first end 122 that provides a space where the exhaust gas 64 may accumulate to and maintain a volume that is able to be entrained in the intake air 64 has it flows around and through the pre-mixing cavity 136 to create at least a portion of the homogenous charge air 68. Additionally, as the homogenous charge air 68 flows out of the first end 122 it flows along a base wall 158, which defines a transition between the first end 122 and the second end 124, as well as the base of the mixing chamber 128.

Figure 5:
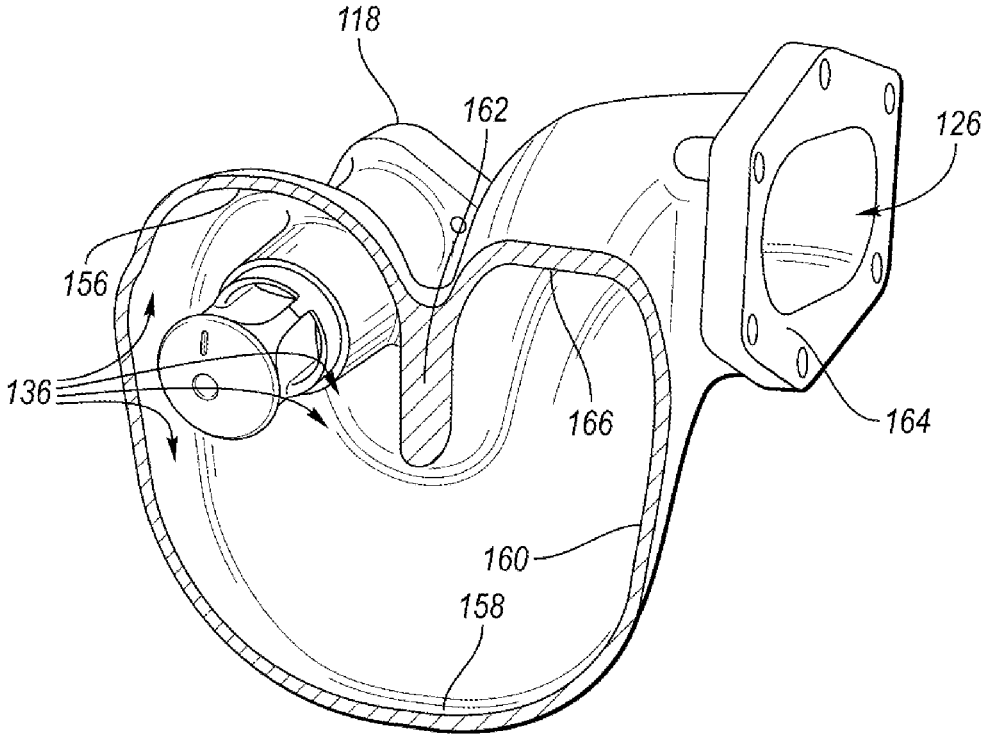
FIG. 5 is a partial section view of a rear half of the U-shaped exhaust gas mixer of FIG. 2.

Turning to FIG. 5, the internal area of the U-shaped housing 120 is further illustrated showing the rear-inner housing wall 150 and the base wall 158 as unitary piece. Specifically, illustrated is the unitary smooth shape of the back wall 150 and base wall 158 transitioning to define the pre-mixing chamber 136 transition to the mixing chamber 128. The mixing chamber 128 is further defined by a right-side interior wall 160 extending up to the charge air outlet 126. As illustrated, an interior divider wall 162 is included to further define the pre-mixing cavity 136 as a separate area within U-shaped housing 120 and further divide the first end 122 and the second end 124. The interior divider wall 162 also further separates the first-top housing wall 156 from a second-top housing wall 166, the interior divider wall 162 may extend a predetermined distance toward the base wall 158 to provide an additional surface that promotes a turbulent flow to promote additional mixing as the intake air 64 and the entrained exhaust gas 66 move through the mixing chamber 128. Additionally, the second end 124 includes a charge air outlet mounting flange 164 extending radially around the charge air outlet 126 and configured to connect the U-shaped housing 120 to at least one of the second air intake pipes tubes or conduits 26 or directly to the one or more air intake manifolds 22.

Figure 6:
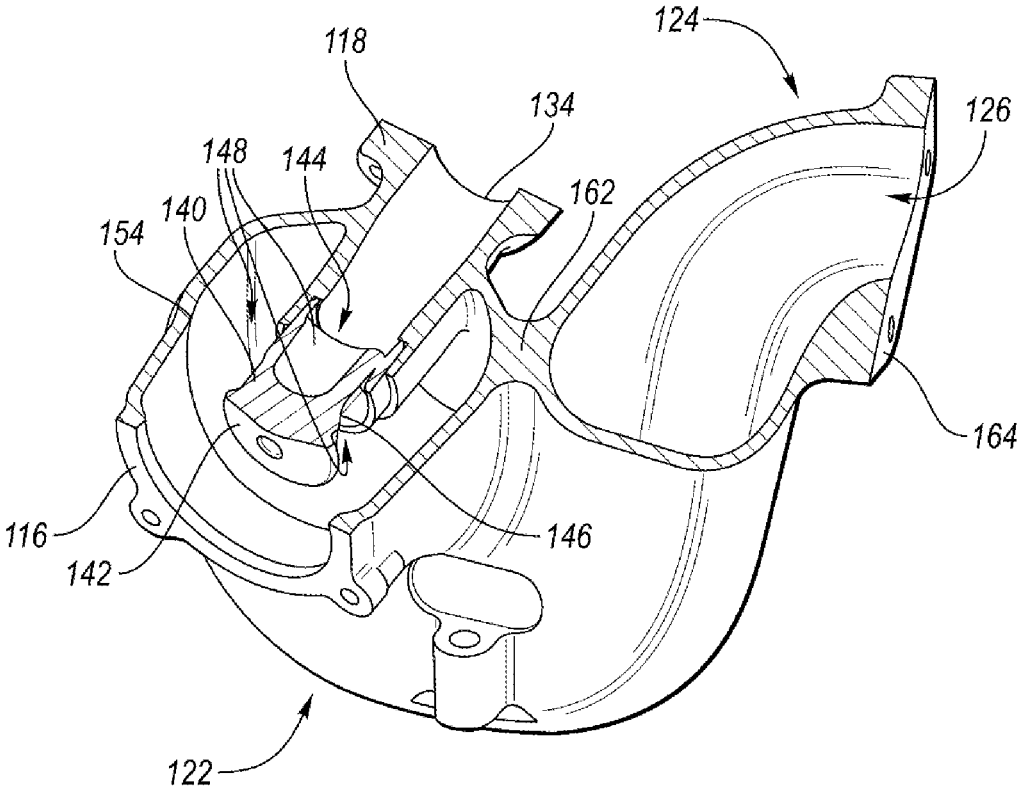
FIG. 6 is a partial section view of a lower portion of the U-shaped exhaust gas mixer of FIG. 2.

FIG. 6 illustrates a detailed section of the exhaust gas 66 flow path as it enters the U-shaped housing 120 through the exhaust gas inlet 134 passing through the pre-mixing conduit 114 and out a pre-mixing head 140 and into the pre-mixing cavity 136. The pre-mixing head 140 may include cap 142, a hollow cylindrical base 144 and a main body 146, the main body 146 including an exhaust gas supply port 148, the exhaust gas supply port 148 fluidly connecting the pre-mixing conduit with the pre-mixing cavity 136 through the hollow cylindrical base 144. Thus, the exhaust gas 66 flows from the engine 12 into the exhaust gas inlet 134, through the pre-mixing conduit 114, through the hollow cylindrical base, through the main body 146, out at least one exhaust gas supply port 148 and into the pre-mixing cavity 136. It should be understood that the at least one exhaust gas supply port 148 may be a plurality of exhaust gas supply ports 148 configured concentrically about the main body 146.

Figure 7:
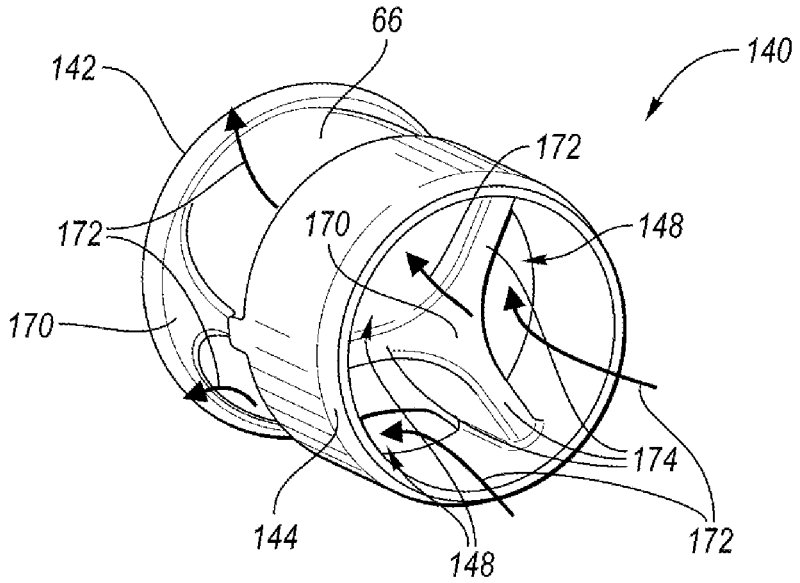
FIG. 7 is rear side perspective view of an exemplary pre-mixing head.
Figure 8:
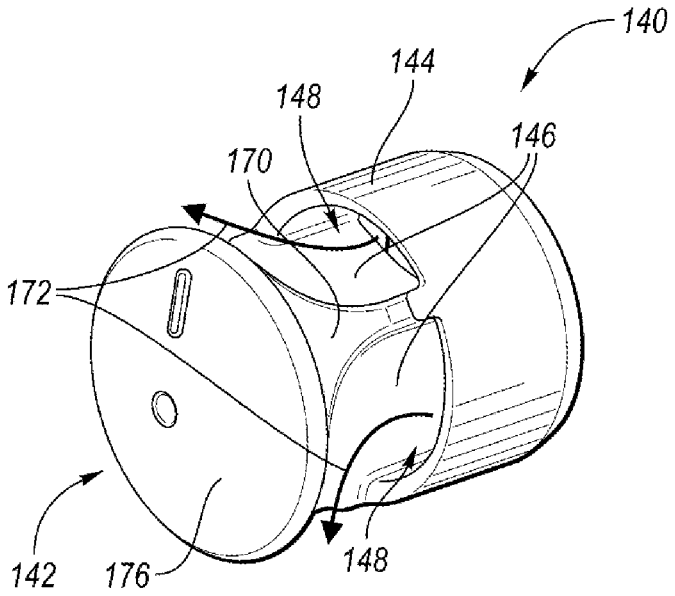
FIG. 8 is a front side perspective view of the exemplary pre-mixing head of FIG. 7.

Turning now to FIGS. 7 and 8, the pre-mixing head 140 is illustrated in detail as a separate element that may be attached to the pre-mixing conduit 114 by a press fit, adhesive, thread or other known attachment method and constructed of a metallic, plastic or composite or other known material commonly used in exhaust gas recirculation systems 30. Additionally, it is contemplated that the pre-mixing head 140 may be a unitary element cast directly with the U-shaped housing 120 and then it may be machined to create the flow path through the exhaust gas supply port 148. As illustrated, the hollow cylindrical base 144 is connected to the main body 146 via a lattice structure 170. The lattice structure 170 extends concentrically outward from the main body 146 and provides support through at least one lattice member 174 to the hollow cylindrical base 144 while also providing at least one flow path or fluid path, which is illustrated as three distinct flow paths 172 separated by the at least one lattice members 174. The at least one flow path 172 allow the exhaust gas 66 to flow through the hollow cylindrical base 144 across the main body 146, out the exhaust gas supply ports 148 and past the cap 142 of the pre-mixing head 140 as it flows into the pre-mixing cavity 136. The cap 142 is illustrated having a convex outer surface 176. However, it is contemplated that the cap 142 may be configured in any known surface shape, such as flat, concave or conical and the convex outer surface 176 may provide an additional surface that causes the intake air 64 to become turbulent as the intake air 64 flows into the pre-mixing cavity 136 around the pre-mixing head 140.

Additionally, it should be understood that the specific dimensions of the U-shaped housing 120 are configured to create a small envelope package for the mixer 100. The shape and transitioned surfaces of the pre-mixing cavity 136 and the mixing chamber 128 provide walls and surfaces, discussed above that may result in agitation and turbulent flow of the intake air 64 and the exhaust gas 66 to promote entraining the exhaust gas 66 within the intake air 64 to create the homogenous charge air 68 that flows out of the U-shaped housing 120 and into the intake manifold 22 to be burned during a combustion cycle of the engine 12 while reducing any EGR pressure loss and shortening the mixing distance from the exhaust gas 66 introduction into the U-shaped housing 120 to a homogenous charge air 68 without the use of a backpressure valve or an EGR pump as shown, at least, in FIGS. 2 and 3.

It should be understood that the designations of first, second, third, fourth, etc. for any component, state, or condition described herein may be rearranged in the claims so that they are in chronological order with respect to the claims. Additionally, the different embodiments disclosed herein may be implemented individually or in any combination, the specific arrangements are examples and do not limit any combination.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A vehicle comprising: an internal combustion engine having at least one cylinder; an air intake system configured to deliver intake air to the at least one cylinder; and an exhaust gas recirculation system having, at least one tube configured to direct the exhaust gas away from the at least one cylinder, and a U-shaped exhaust gas mixer configured to direct the exhaust gas from the at least one tube into the air intake system, wherein the U-shaped exhaust gas mixer including a pre-mixing cavity, a mixing chamber, a divider wall, a pre-mixing conduit, and at least one exhaust gas pre-mixing head fluidly connected to the at least one tube such that the exhaust gas flows around the pre-mixing conduit and the pre-mixing head to entrain the exhaust gas into the intake air, the divider wall extending vertically and at least partially separating the mixing chamber and the pre-mixing cavity, and the pre-mixing cavity configured to maintain an exhaust gas flow pressure during dispersing and entraining of the exhaust gas with the intake air as the intake air flows through the U-shaped exhaust gas mixer prior to delivering the intake air and exhaust gas to the at least one cylinder.

2. The vehicle of claim 1, wherein the U-shaped exhaust gas mixer includes a first end and a second end, the first end includes an air intake aperture, the air intake aperture is configured to receive and direct the intake air to the pre-mixing cavity and into the mixing chamber to a mixer outlet, and the mixing chamber is configured downstream of the pre-mixing cavity and upstream of the mixer outlet, which is in fluid communication with the at least one cylinder.

3. The vehicle of claim 1, wherein the pre-mixing head includes at least one exhaust gas dispersing port configured to disperse exhaust gas into the pre-mixing cavity.

4. The vehicle of claim 1, wherein the pre-mixing head includes a plurality of exhaust gas dispersing ports configured concentrically around a pre-mixing head base.

5. The vehicle of claim 3, wherein a pre-mixing head base is at least partially hollow and interconnected to a pre-mixing head cap through at least one lattice member, and the lattice member defines an internal fluid path of the at least one exhaust gas dispersing port.

6. The vehicle of claim 1, wherein the at least one exhaust gas pre-mixing head includes a main body portion having a cap on a first end and a hollow base section on an opposite end, and the main body defines a lattice structure configured with at least three apertures fluidly connecting the pre-mixing conduit to the pre-mixing cavity.

7. The vehicle of claim 1, wherein the U-shaped exhaust gas mixer is a U-shaped housing defining a U-shaped cavity having a first side and a second side, the first side of the U-shaped cavity houses the pre-mixing cavity and the second side of the U-shaped cavity houses the mixing chamber, and the entraining of the exhaust gas and the intake air results from the exhaust gas and the air colliding into a first wall and a second wall of the U-shaped cavity.

8. An exhaust gas recirculation system for an engine comprising: a conduit configured to direct an exhaust gas away from an exhaust manifold; and a U-shaped exhaust gas mixer configured to direct the exhaust gas from the conduit, into an engine air intake system, the U-shaped exhaust gas mixer is arranged with a pre-mixing cavity, a mixing chamber, a divider wall, a pre-mixing conduit, and at least one exhaust gas pre-mixing head fluidly connected to at least one tube such that the exhaust gas flows around the pre-mixing conduit and the pre-mixing head to entrain the exhaust gas into the intake air, the divider wall extending vertically and at least partially separating the mixing chamber and the pre-mixing cavity, and the pre-mixing cavity configured to disperse the exhaust gas and entraining the exhaust gas into an intake air flow prior to distribution into an intake manifold of an engine.

9. The exhaust gas recirculation system of claim 8, wherein the U-shaped exhaust gas mixer includes a housing having an intake opening, an exhaust gas intake, and a charge air outlet.

10. The exhaust gas recirculation system of claim 9, wherein the pre-mixing conduit extends from the exhaust gas intake and through an internal wall of the housing, and the pre-mixing conduit and the internal wall are configured opposite the intake opening.

11. The exhaust gas recirculation system of claim 10, wherein the pre-mixing head extends from an end of the pre-mixing conduit and extends toward the intake opening.

12. The exhaust gas recirculation system of claim 11, wherein the pre-mixing conduit and pre-mixing head are a pre-mixing zone configured to house and disperse a volume of the exhaust gas prior to the entraining of the exhaust gas into the intake air flow in the pre-mixing cavity and the mixing chamber.

13. The exhaust gas recirculation system of claim 8, wherein the pre-mixing head extends through an outer wall of the U-shaped housing and has three concentrically distributed exhaust gas ports defined in a main body by a lattice structure, and the exhaust gas ports are configured to disperse the exhaust gas into the pre-mixing cavity.

14. The exhaust gas recirculation system of claim 8, wherein the U-shaped exhaust gas mixer is a U-shaped housing defining a U-shaped cavity having a first side and a second side, and the first side of the U-shaped cavity houses the pre-mixing cavity and the second side of the U-shaped cavity houses the mixing chamber.

15. An engine exhaust gas mixer comprising: a housing forming a pre-mixing zone, a mixing chamber, a divider wall, a pre-mixing conduit, and at least one exhaust gas pre-mixing head fluidly connected to at least one tube such that exhaust gas flows around the pre-mixing conduit and the pre-mixing head to entrain the exhaust gas into the intake air, the divider wall extending vertically and at least partially separating the mixing chamber and the pre-mixing zone, the pre-mixing zone being at an intake end, and the housing further defining an exhaust gas inlet and an intake air inlet, the pre-mixing conduit configured between the exhaust gas inlet and the intake air inlet, and configured to distribute and disperse a volume of exhaust gas prior to entraining the exhaust gas in at least a portion of an intake air main flow and prior to entering the mixing chamber for distribution into the engine.

16. The exhaust gas mixer of claim 15, wherein the housing is a U-shaped housing, the U-shaped housing defines a U-shaped cavity having a first side and a second side, and the first side of the U-shaped cavity houses a pre-mixing cavity and the second side of the U-shaped cavity houses the mixing chamber.

17. The exhaust gas mixer of claim 16, wherein the exhaust gas inlet extends outward from a rear wall of the housing and includes a through hole connected to the pre-mixing conduit extending inward into the U-shaped cavity first side from an inner surface of the rear wall, the pre-mixing conduit has a pre-mixing gas distribution head, and the pre-mixing gas distribution head extends into the pre-mixing cavity to disperse the exhaust gas into a flow of intake air moving therethrough.

18. The exhaust gas mixer of claim 15, wherein a pre-mixing gas distribution head is connected to the pre-mixing conduit and fluidly connects to the exhaust gas inlet, and the pre-mixing gas distribution head is configured to disperse the exhaust gas while maintaining a constant pressure thereby minimizing a pressure loss.

19. The exhaust gas mixer of claim 18, wherein the at least one pre-mixing conduit and the pre-mixing gas distribution head are configured to disperse the exhaust gas into the intake at a constant pressure.

* * * * *